United States Patent [19]

Yamamoto et al.

[11] 4,422,061

[45] Dec. 20, 1983

[54] LAMINATED CORE OF TRANSFORMER

[75] Inventors: Takaaki Yamamoto; Yoshihiro Ohya, both of Kitakyushu, Japan

[73] Assignee: Nippon Steel Corporation, Tokyo, Japan

[21] Appl. No.: 298,800

[22] Filed: Sep. 2, 1981

[30] Foreign Application Priority Data

Jan. 29, 1981 [JP] Japan ..... 56-10870

[51] Int. Cl.[3] ..... H01F 27/24

[52] U.S. Cl. ..... 336/218; 336/212

[58] Field of Search ..... 336/218, 212

[56] References Cited

U.S. PATENT DOCUMENTS 2,489,977 11/1949 Porter ..... 336/218
4,100,521 7/1978 Hori ..... 336/218

FOREIGN PATENT DOCUMENTS 1488357 4/1969 Fed. Rep. of Germany ..... 336/218
1295055 5/1969 Fed. Rep. of Germany ..... 336/218
1459495 12/1965 France ..... 336/218

*Primary Examiner*—A. T. Grimley
*Assistant Examiner*—Susan Steward
*Attorney, Agent, or Firm*—Kenyon & Kenyon

[57] ABSTRACT

In the conventional stacking method of the laminated core of a transformer, grain-oriented silicon steel sheet pieces of an identical grade or the identical magnetic properties are used as legs and yokes of the core. In a highly oriented silicon steel sheet having a high $B_8$ value due to excellent magnetic properties in the rolling direction of the sheet, the excellent magnetic properties cannot be fully utilized for the watt loss reduction in the conventional stacking method. In a laminated core of the present invention, the transformer core comprises a grain-oriented silicon steel sheet having a higher orientation used for a leg(s) and a grain-oriented silicon steel sheet having a lower orientation used for a yoke(s). The former steel has the $B_8$ value of generally 1.88 Tesla or higher and preferably 1.89 Tesla or higher. The latter steel has the $B_8$ value of generally 1.86 Tesla or lower. A low watt loss, particularly at a low or medium magnetic flux density, can be achieved by the present invention, while decreasing the cost of the transformer.

5 Claims, 2 Drawing Figures

LAMINATED CORE OF TRANSFORMER

BACKGROUND OF THE INVENTION

The present invention relates to a laminated core of a transformer.

A grain-oriented silicon steel sheet used for the laminated core of a transformer has such a general characteristic that the magnetic properties, i.e. watt loss and permeability, are good in the rolling direction of the sheet, but are impaired when measured along a direction different from the rolling direction. With reference to FIGS. 1 and 2, conventional transformer cores are explained.

In the drawings:

FIG. 1 illustrates the structure of a core of a three phase transformer; and, FIG. 2 illustrates the structure of a core of a single phase transformer.

Since grain-oriented silicon steel has the general characteristic as stated above, the structure of a laminated transformer core is devised so that the magnetizing direction of the core coincides with the rolling direction, as much as possible, thereby decreasing the watt loss of the core as much as possible. In FIGS. 1 and 2 the double arrows indicate the rolling direction, while the reference numerals 1, 2 and 3, 4 indicate the legs and yokes of the transformer core, respectively. The term "leg(s)" used herein designates a portion of the transformer core where a coil is provided, while the term "yoke(s)" used herein designates a portion of the transformer core connecting legs with each other. In the single phase transformer core illustrated in FIG. 2, the rolling and magnetizing directions are substantially coincidental with each other. However, in the three phase transformer core illustrated in FIG. 1, the rolling and magnetizing directions are substantially coincident with each other at the legs 1 and 2 but the yokes 3 and 4 are inevitably magnetized in a direction deviated from the rolling direction. Therefore, the excellent magnetic properties of the transformer core material in the rolling direction is completely utilized in the single phase transformer core to decrease the watt loss, while the watt loss property of the three phase transformer core cannot reflect the excellent magnetic properties mentioned above. These facts mean that there is a tendency in which the watt loss of a three phase transformer core may not be improved directly by and proportionally to the magnetic property enhancement in the rolling direction. This tendency becomes more appreciable in a highly oriented silicon steel sheet, which has much better magnetic properties in the rolling direction than a relatively low oriented silicon steel sheet, i.e. a conventional grain-oriented silicon steel.

The term "a highly oriented silicon steel sheet" used herein designates a silicon steel sheet: which exhibits a so-called Goss texture or the (110) (001) orientation having (110) plane expressed by the Miller index parallel to the rolling plane and also having one of the (001)

orientations, i.e. axis of easy magnetization, aligned parallel to the rolling direction; and, which exhibits a degree of grain alignment in terms of the deviation from the ideal [001] orientation not exceeding 3°. The magnetic flux density $B_8$ at the magnetizing field H of 800 A/m, which represents the degree of grain orientation, is 1.88 Tesla or higher, preferably 1.89 Tesla or higher, in the highly oriented silicon steel sheet. In addition, the term "the conventional relatively low oriented silicon steel sheet" used herein designates a grain-oriented silicon steel sheet having the $B_8$ value lower than the above mentioned values, generally 1.86 Tesla or lower.

A conventional core of the single or three phase transformer has been manufactured from pieces of a grain-oriented silicon steel sheet having an identical grade of magnetic flux density. The highly oriented silicon steel sheet and the conventional relatively low oriented silicon steel sheet have not been used in combination in a transformer core in the prior art. As stated above, the magnetic properties of a grain-oriented silicon steel sheet are deteriorated in directions which deviate from the rolling direction, and this deterioration is greater when the degree of grain orientation into the Goss texture is higher. Therefore, when the highly oriented silicon steel sheet is used for the three phase transformer core, it is difficult to achieve an expectedly remarkable watt loss reduction as compared with that which is achieved when using the conventional relatively low oriented silicn steel sheet. This is illustrated in Table 1, below. The highly oriented silicon steel sheet (Grade G6H) and the conventional relatively low oriented silicon steel sheet (Grade G9) are used for each of the single and three phase transformer cores manufactured by the stacking methods of FIGS. 2 and 1, and the watt loss ratio of the three phase transformer watt loss to the single phase transformer watt loss are given in Table 1. This watt loss ratio can be deemed to represent an orientation property of the core material.

TABLE 1

| Steel Grade | Sheet Thickness (mm) | Watt Loss of Three Phase Transformer (W/kg) | | | Watt Loss of Single Phase Transformer (W/kg) | | | Three Phase/ Single Phase | | |
|---|---|---|---|---|---|---|---|---|---|---|
| | | $W^{10}/60$ | $W^{15}/60$ | $W^{17}/60$ | $W^{10}/60$ | $W^{15}/60$ | $W^{17}/60$ | $W^{10}/60$ | $W^{15}/60$ | $W^{17}/60$ |
| G6H | 0.30 | 0.556 | 1.264 | 1.605 | 0.469 | 1.069 | 1.370 | 1.185 | 1.182 | 1.171 |
| G9 | 0.30 | 0.560 | 1.299 | 1.782 | 0.485 | 1.130 | 1.556 | 1.155 | 1.150 | 1.145 |

As shown in Table 1, the watt loss of the three phase transformer core is clearly low when the core material is of the highly oriented silicon steel sheet (G6H). However, the watt loss ratio "Three phase/Single phase" of the highly oriented silicon steel sheet (G6H) is higher than or inferior to that of the conventional relatively low oriented silicon steel sheet (G9). Namely, the excellent magnetic properties of the highly oriented silicon steel sheet cannot be fully utilized for the watt loss reduction of the three phase transformer.

It is, therefore, an object of the present invention to provide a transformer core composed of laminated grain-oriented silicon steel sheet pieces having low watt loss, in which the excellent magnetic properties of the sheet in the rolling direction can be fully utilized for the watt loss reduction. Thus, the transformer should have a high performance.

SUMMARY OF THE INVENTION

In accordance with the present invention, a laminated core of a transformer is provided with a grain-oriented silicon steel sheet having a higher orientation used for a leg(s) and a grain-oriented silicon steel sheet having a lower orientation used for a yoke(s). In the present invention, at least individual laminate layers comprise at least one leg made of a grain-oriented silicon steel sheet having a higher orientation and the yokes made of a grain-oriented silicon steel sheet having a lower orientation.

The higher orientation silicon steel sheet is preferably the highly oriented silicon steel sheet, while the lower oriented silicon steel sheet is preferably the conventional relatively low oriented silicon steel sheet. In the laminated core of a transformer core of the present invention, wherein the grain-oriented silicon steel sheets of higher and lower orientations are used in combination, the watt loss equivalent to or lower than that using only the highly oriented silicon steel sheet can be achieved. Furthermore, excellent magnetic properties of a grain-oriented silicon steel sheet in the rolling direction can be reflected or utilized for the watt loss property as fully as in the transformer core using only the conventional relatively low oriented silicon steel sheet. When the present invention is compared with the prior art of using only the highly oriented silicon steel sheet, it can be said that the present invention provides a transformer core with a high perfomance equivalent or superior to that using only the highly oriented silicon steel sheet. When the present invention is compared with the prior art of using only the conventional relatively low oriented silicon steel sheet, it can be said that this sheet is replaced only partially with the highly oriented silicon steel sheet, not entirely. It would be surprising for the partial replacement to provide the watt loss equivalent or even superior to that of the entire replacement.

In an embodiment of the present invention, the transformer is a three phase transformer, and at least one leg, but preferably all legs, of the transformer core are made of the grain-oriented silicon steel sheet having a higher orientation.

In the laminate layers, where the higher and lower oriented silicon steel sheets as mentioned above are not used in combination, the grain-oriented silicon steel sheets of an identical grade or orientation are used. However, according to a preferable embodiment of the present invention, all laminate layers are manufactured by the combination of the grain-oriented silicon steel sheets having higher and lower orientations, as described hereinabove.

DETAILED DESCRIPTION

The present invention is hereinafter explained by way of Examples, in which all laminate layers were manufactured by the grain-oriented silicon steel sheets explained hereinafter.

EXAMPLE 1

Figure 1:
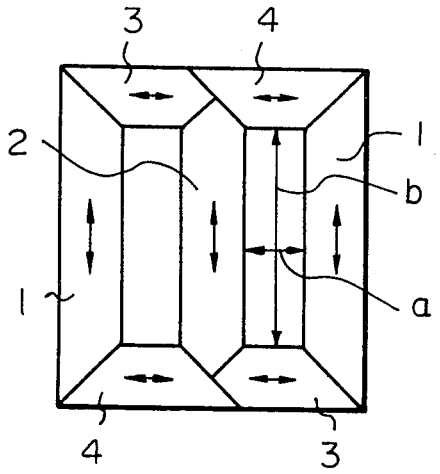

A highly oriented silicon steel sheet (Grade G6H) having the $B_8$ value of 1.94 Tesla was used as the legs 1 and 2 of the three phase transformer shown in FIG. 1. A conventional relatively low oriented silicon steel sheet (Grade G9) having the $B_8$ value of 1.85 Tesla was used as the yokes 3 and 4. The above mentioned two steel sheets are hereinafter simply referred to as G6H and G9, by their grades, respectively. The window ratio "b/a" in FIG. 1 was 3.67.

EXAMPLE 2

The G6H was used as the leg 1 and the G9 was used as the other members of the core, i.e., the leg 2 and yokes 3 and 4.

EXAMPLE 3 (COMPARATIVE EXAMPLE)

The G9 was used as the legs 1 and 2, while the G6H was used for as the yokes 3 and 4.

Figure 2:
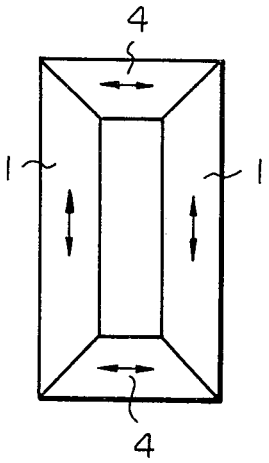

The watt loss of the above Examples is given in Table 2, below. In this table, the following cores of the single phase transformer are illustrated in FIG. 2:

(A) G6H and G9 were used as the legs 1 and the yokes 4, respectively, and;

(B) G9 and G6H were used for the legs 1 and the yokes 4, respectively. The results of (A) and (B), above, are also given correspondingly to Examples 1 and 3, respectively. In addition, the ratio of the watt loss of the three phase transformer to the single phase transformer (Three phase/Single phase) is given in Table 2.

TABLE 2

| Examples | Sheet Thickness (mm) | Watt Loss of Three Phase Transformer (W/kg) | | | Watt Loss of Single Phase Transformer (W/kg) | | | Three Phase/Single Phase | | |
|---|---|---|---|---|---|---|---|---|---|---|
| | | $W^{10}/60$ | $W^{15}/60$ | $W^{17}/60$ | $W^{10}/60$ | $W^{15}/60$ | $W^{17}/60$ | $W^{10}/60$ | $W^{15}/60$ | $W^{17}/60$ |
| 1 | 0.30 | 0.545 | 1.243 | 1.599 | 0.479 | 1.082 | 1.411 | 1.138 | 1.149 | 1.133 |
| 2 | 0.30 | 0.551 | 1.258 | 1.657 | — | — | — | — | — | — |
| 3 | 0.30 | 0.558 | 1.290 | 1.720 | 0.485 | 1.112 | 1.503 | 1.151 | 1.160 | 1.144 |

The following facts will be apparent from Tables 1 and 2.

A. The watt loss of the three phase transformer of Example 1 is not inferior to the watt loss of the three phase transformer using only G6H (Table 1). An appreciable reduction of the watt losses $W^{10}/60$ and $W^{15}/60$ at a low and medium magnetic flux density as compared to the watt losses in Table 1 is achieved in Example 1. In addition, the "Three phase/Single phase" ratio in Example 1 is at almost the same level as that of G9 of Table 1. This means that the excellent magnetic properties of the highly oriented silicon steel sheet can be reflected or utilized for the watt loss reduction of a transformer in almost the same extent as in the transformer core using only the conventional relatively low oriented silicon steel sheet.

B. The watt loss of the three phase transformer of Example 2 is greater than that of Example 1. In Example 2, G9 pieces (the conventional relatively low oriented silicon steel sheet) are excessively used and, therefore, the watt loss of the core cannot be decreased to a very low level.

C. The watt loss of the three phase transformer core and the "Three phase/Single phase" ratio in Example 3 are at almost the same level as those of G9 in Table 1.

It will be concluded from the facts given in items A, B and C, above, that, when the transformer core is manufactured by the highly oriented silicon steel sheet and the conventional relatively low oriented silicon steel sheet used in combination, the highly oriented silicon steel sheet should not be used as the yokes and the conventional relatively low oriented silicon steel sheet should be used as the yokes, so as to reduce effectively the watt loss of the transformer core. It is most advisable to use the conventional relatively low oriented silicon steel sheet only as the yokes and to use the highly oriented silicon steel sheet as the legs, as in Example 1. Contrary to this, if one or more legs made of the highly oriented silicon steel sheet are replaced with the conventional relatively low oriented silicon steel sheet, the watt loss of the transformer core is increased. In the stacking method of Example 1, the excellent properties of the highly oriented silicon steel sheet are reflected in the watt loss of a transformer core, as fully as in the conventional stacking method using only the conventional relatively low oriented silicon steel sheet. Furthermore, the watt loss $W^{15}/60$ at a low or medium magnetic flux density is substantially improved over the watt loss $W^{15}/60$ of G6H given in Table 1, which is particularly significant in a transformer designed to operate under a magnetic flux density, e.g. about 1.5 Tesla, which is lower than a conventional high magnetic flux density, e.g. 1.7 Tesla.

The weight proportion of yokes 3, 4 to the core is approximately 35%, when the window ratio "b/a" in FIG. 1 is 3.67. Since the yokes 3, 4 can be made of the conventional relatively low oriented silicon steel sheet, which is less expensive than the highly oriented silicon steel sheet, it is possible to manufacture the transformers at an advantageously low cost.

We claim:

1. A three-phase transformer having a laminated core of the type having at least three legs and at least two yokes joining said at least three legs, the three-phase transformer further having at least three coils wound on respective ones of the legs, the three-phase transformer further comprising:

a plurality of leg portion laminate layers formed of a first grain-oriented silicon steel sheet having a first degree of grain orientation; and a plurality of yoke portion laminate layers formed of a second grain-oriented silicon steel sheet having a second degree of grain orientation, in each of the at least two yokes, said first degree of grain orientation being higher than said second degree of grain orientation.

2. A three-phase transformer according to claim 1, characterized in that said first grain-oriented silicon steel sheet having said higher degree of grain orientation is a highly oriented silicon steel sheet, and said second grain-oriented silicon steel sheet having a lower degree of grain orientation is a conventional, relatively low oriented silicon steel sheet.

3. A three-phase transformer according to claim 1 or 2, characterized in that the at least three legs of the laminated core are each provided with a leg portion laminate layer made of said first grain-oriented silicon steel sheet having said first degree of grain orientation.

4. A three-phase transformer according to claim 3, characterized in that a $B_8$ characteristic of said first grain-oriented silicon steel sheet has a minimum value of 1.88 Tesla, and a $B_8$ value of said second grain-oriented silicon steel sheet has a maximum value of 1.86 Tesla.

5. A three-phase transformer according to claim 2, wherein all leg portion laminate layers of the at least three legs of the laminated core are formed of said first grain-oriented silicon sheet steel.

* * * * *